US006443044B1

(12) United States Patent
Dillon

(10) Patent No.: US 6,443,044 B1
(45) Date of Patent: Sep. 3, 2002

(54) FEEDER/DELINKER FOR GATLING GUN

(76) Inventor: Michael J. Dillon, 8009 E. Dillon's Way, Scottsdale, AZ (US) 85260

( * ) Notice: Subject to any disclaimer, the term of this patent is extended or adjusted under 35 U.S.C. 154(b) by 0 days.

(21) Appl. No.: 09/604,366

(22) Filed: Jun. 27, 2000

(51) Int. Cl.[7] ..... F41A 7/06
(52) U.S. Cl. ..... 89/12
(58) Field of Search ..... 89/11, 12, 13.05, 89/9

(56) References Cited

U.S. PATENT DOCUMENTS

| | | | | | |
|---|---|---|---|---|---|
| 3,380,343 | A | * | 4/1968 | Chiabrandy et al. | 89/12 |
| 3,766,821 | A | * | 10/1973 | Cozzy et al. | 89/12 |
| 3,868,884 | A | * | 3/1975 | Rose et al. | 89/11 |

FOREIGN PATENT DOCUMENTS

| | | | | |
|---|---|---|---|---|
| GB | 13504 | * | 7/1892 | 89/12 |

* cited by examiner

*Primary Examiner*—Stephen M. Johnson
(74) *Attorney, Agent, or Firm*—Frank J. McGue

(57) ABSTRACT

A feeder/delinker for a gatling gun is disclosed. The feeder/delinker comprises a housing having a drive gear rotationally coupled to a ring of gatling gun barrels extending therethrough, A push rod guide with a plurality of push rods slidably received therein is mounted within the housing. The push rods correspond to and are oriented parallel to the gatling gun barrels. The push rod guide is rotationally coupled to the drive gear and a shaft which extends through the push rod guide. The plurality of push rods slide forwardly and backwardly within the push rod guide. A drive subassembly is mounted forwardly of the push rod guide and defines a plurality of cartridge receiving channels corresponding to and aligned with the plurality of push rods. A stripper subassembly is mounted forwardly of the drive subassembly on the shaft and defines a plurality of stripper channels corresponding to and aligned with the plurality of push rods. Each of the plurality of stripper channels is adapted to receive and prevent longitudinal movement of a cartridge link. An exhaust port is provided for expelling cartridge links. A linked cartridge from a belt of cartridges is positioned in one of the drive subassembly channels and the corresponding stripper subassembly channel is urged longitudinally forwardly by the corresponding push rod. The stripper subassembly retains the cartridge link thereby stripping the cartridge from the link, the links being expelled via the exhaust port. A feeder sprocket receives cartridges from the stripper subassembly while an end plate having two parallel guide walls adapted to engage the shoulder of a cartridge guides the cartridge in the feeder sprocket to the gatling gun. A pair of the hatch doors is mounted on the housing and allows the user access to the interior of the housing.

12 Claims, 5 Drawing Sheets

FEEDER/DELINKER FOR GATLING GUN

TECHNICAL FIELD

The present invention relates to feeder/delinkers for weapons, and, more particularly, to feeder/delinkers used in conjunction with gatling guns.

BACKGROUND OF THE INVENTION

The gatling gun, a forerunner of the contemporary machine gun, was introduced by Richard J. Gatling in 1862. This weapon incorporates a ring of barrels that fire sequentially as the ring of barrels is rotated. In early versions, the barrels were rotated by means of a hand crank; more recent versions incorporate a drive motor. The U.S. Army used the gatling gun in the battle of Santiago, Chile in 1898. Other nations used it in colonial wars in Africa and Asia until the beginning decades of the $20^{th}$ Century; it was also used by the United States in the Vietnam conflict.

To feed a gatling gun, a feeder/delinker mechanism takes belted ammunition, strips (delinks) the individual cartridges from the belts and then feeds the delinked ammunition to the gatling gun. While the gatling gun is still in service, the gun was last manufactured by the firearms division of the General Electric Company about twenty years ago. Thus, there is a continuing need for spare and replacement components and improved feeders.

The demand for replacement parts is concentrated on the feeder/delinker unit which has become a weak point in the overall system. One persistent problem has been the tendency of the feeder/delinker unit to jam due to misalignment of the cartridges as they are fed into the delinker. Another problem relates to breakage and consequent jamming due to the fragility of the various sprockets incorporated into the feeder/delinker. Yet another deficiency in the prior art design is the difficulty and time required for clearing the jammed conditions once they occur, this being due to the lack of access to the interior of the feeder/delinker. Because of this lack of access, the jamming can only be cleared by first removing the feeder/delinker from the gun and disassembling the unit—a time consuming procedure.

Another problem is the requirement to rotate the barrels in order to load linked ammunition into the feeder. Rotating the barrels can cause the gun to fire unintentionally. Rotating the barrels is also awkward when the barrels are hot. Lastly, rotating the barrels requires the helicopter gunner to lean out into a one hundred mile per hour slipstream.

Still another problem with the current design feeder/delinker is that in case of a severe jam it is necessary to force the rotation of the internal sprockets by using a straight bladed screw driver as a lever on the gear teeth. The new design provides two radius edged surfaces to prevent damage to the cast housing and to allow easier access to the gear teeth.

The prior art feeder/delinker was also functionally deficient in terms of its operation with sabot light armor piercing (SLAP) ammunition. With this type of ammunition, the prior art mechanism did not reliably chamber the cartridge as they were "handed" off from the feeder/delinker into the gun. During this part of the operation, control of the fore and aft positions of the cartridge was not adequate to assure trouble-free operation.

The prior art feeder/delinker is also deficient in that an ammunition jam could bend the pin that secured the drive gear to the main driven component thereby setting the entire unit out of time and rendering is inoperable.

The present invention addresses the problems of the prior art feeder/delinker and offers improvements essential to their correction.

SUMMARY OF THE INVENTION

In accordance with the invention claimed a number of improvements are made in the feeeder/delinker unit over the version most recently produced by the General Electric Company.

It is, therefore, one object of this invention to provide a means for improving the degree of alignment achieved within the feeder/delinker.

Another object of this invention is to modify the design of the internal components of the feeder/delinker as needed to substantially eliminate the breakage due to fragile parts.

A further object of this invention is to modify the design of the end plate as needed to assure reliable, trouble-free operation of the feeder/delinker with SLAP ammunition.

A still further object of this invention is provide convenient access to the interior of the feeder/delinker via a hatch so that any jammed condition may be corrected without removing the feeder/delinker from the gatling gun.

Another object of this invention is to provide a means to hold the ammunition in the proper location while closing the loading cover. This is accomplished by use of a split hatch design.

A still further object of this invention is to make alignment of the linked ammunition more consistent as it is pulled into the feeder/delinker. This is accomplished through the addition of a second sprocket to the rear of the links.

Yet another object of this invention is to provide a means for attaching various link exhaust chutes.

Further objects and advantages of the invention will become apparent as the following description proceeds and the features of novelty which characterize the invention will be pointed out with particularity in the claims annexed to and forming part of the specification.

BRIEF DESCRIPTION OF THE DRAWINGS

The present invention may be readily described by reference to the accompanying drawings in which.

DESCRIPTION OF THE PREFERRED EMBODIMENT

Figure 1:
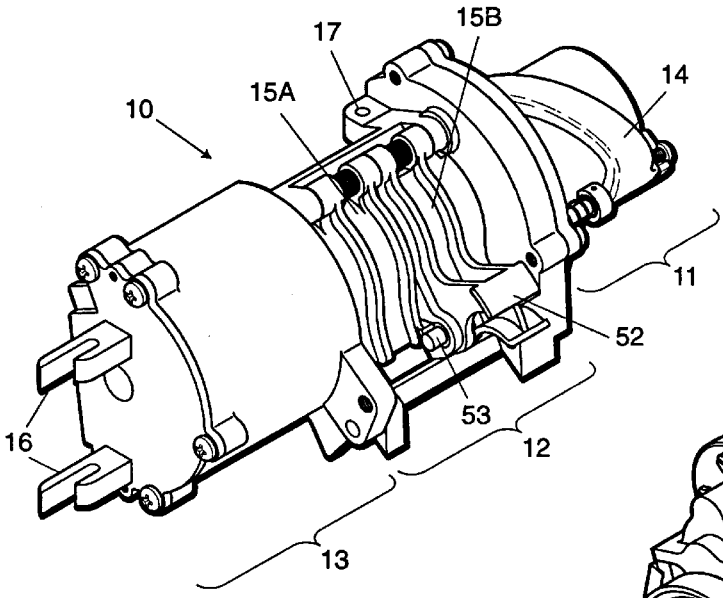
FIG. 1 is a perspective view of a feeder/delinker of the present invention.

Referring more particularly to the drawings by characters of reference, FIG. 1 discloses an improved feeder/delinker 10 of the invention comprising a drive stage 11, a delinker stage 12 and a delivery stage 13. Other features of feeder/delinker 10 which are visible in FIG. 1 include the external contours of a ramped or spiraled push-rod drive channel 14, first and second hatch doors 15A and 15B, respectively, forward mounting hooks 16 and rearward mounting hole 17, hooks 16 and hole 17 being provided for use in mounting feeder/delinker 10 to a gatling gun 18 as shown in FIG. 2.

Figure 2:
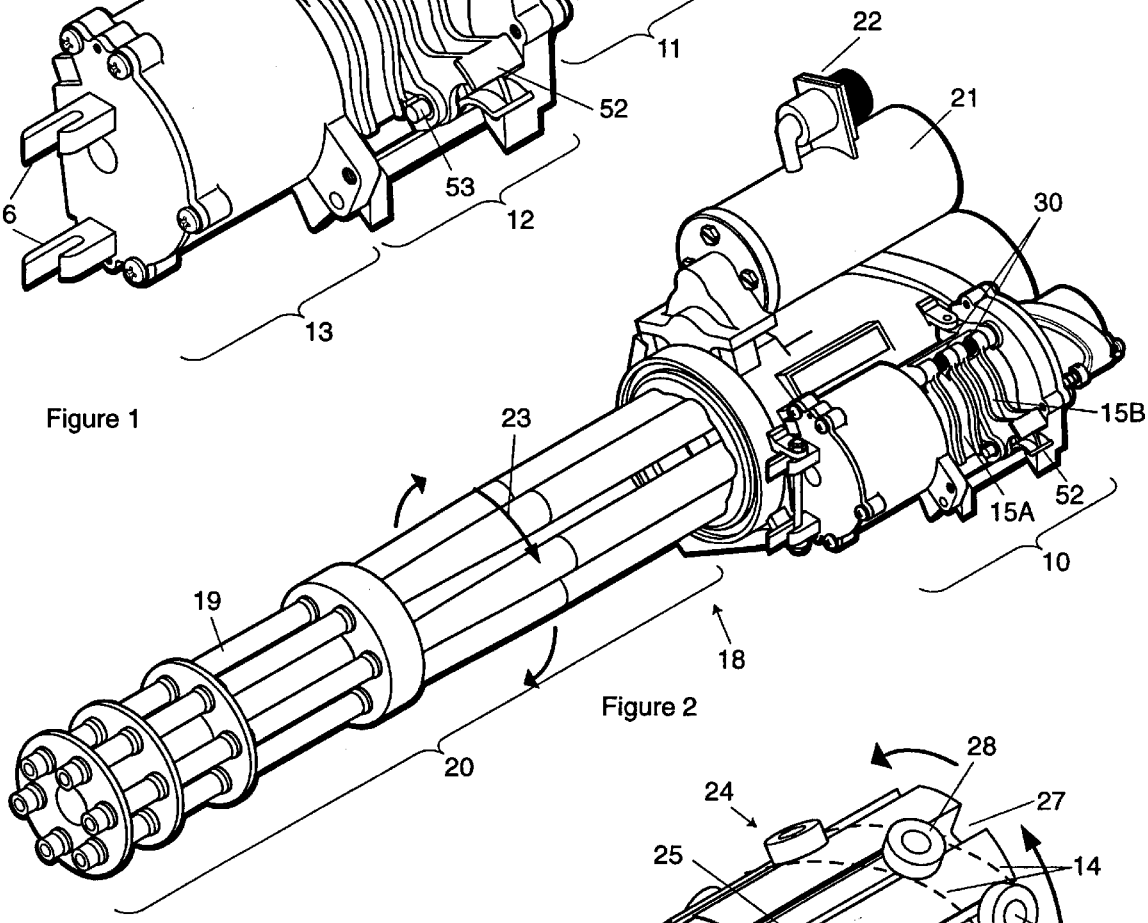
FIG. 2 is a perspective view showing the feeder/delinker of the present invention mounted on a gatling gun.

As shown in FIG. 2, when feeder/delinker 10 is mounted to gatling gun 18, feeder/delinker 10 becomes an essential component of gun 18. Other elements of gatling gun 18 include a rotatable ring 20 of barrels 19, a drive motor 21 and an electrical connector 22.

In the operation of gatling gun 18, drive motor 21 causes ring 20 of barrels 19 to rotate as indicated by an arrow 23. Responding to the rotation of ring 20 of barrels 19, gatling gun 18 fires each barrel 19 sequentially in rapid succession. At the same time, feeder/delinker 10 receives a continuous string of linked ammunition which it delinks and feeds to gatling gun 18.

Figure 3:
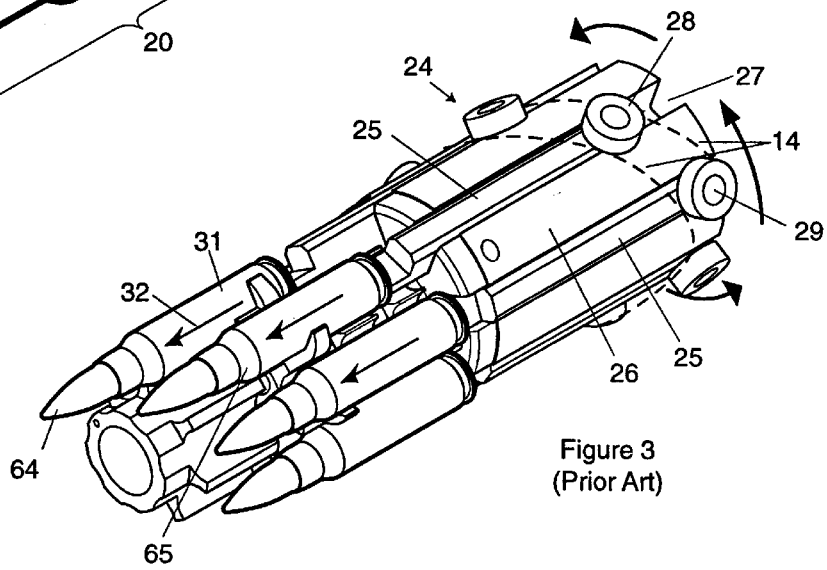
Figure 3 (Prior Art)
FIG. 3 is a functional illustration of the feeder/delinker drive mechanism employed in both the prior art as well as the present invention.

A drive mechanism 24 of gatling gun 18 as shown in FIG. 3 comprises a set of push rods 25, one push rod 25 corresponding to each barrel 19 of gatling gun 18 and a push rod guide 26. In the illustrated embodiment, ring 20 comprises six (6) barrels 19 and, thus, includes six push rods 25.

Push rod guide 26 comprises a cylindrical body having an axis in parallel alignment with the axis of ring 20. Rods 25 move longitudinally inside longitudinal grooves 27 which are uniformly distributed about the cylindrical surface of the cylindrical body, each rod 25 being aligned with corresponding barrel 19.

Each rod 25 has a drive wheel 28 secured to its rearward end by means of an axle 29 that extends outwardly from the outer face of the rod. Wheels 28 are confined within spiral grooved push rod channel 14 represented, in FIG. 3, by the broken lines 14'. Spiral grooved channel 14 is incorporated drive stage 11. As push rod guide 26 rotates about its axis by means of drive motor 21, push rods 25 are constrained by wheels 28 to follow the path of channel 14, thereby moving forward and backward with each rotation of push rod guide 26. As push rods 25 move forewardly, push rods 25 engage the rear of a cartridge 31 and push cartridge 31 forwardly as indicated by arrows 32. As each cartridge 31 is driven forwardly, that cartridge 31 is freed, or delinked, from the linkage and then handed off to the gatling gun 18.

Figure 4:
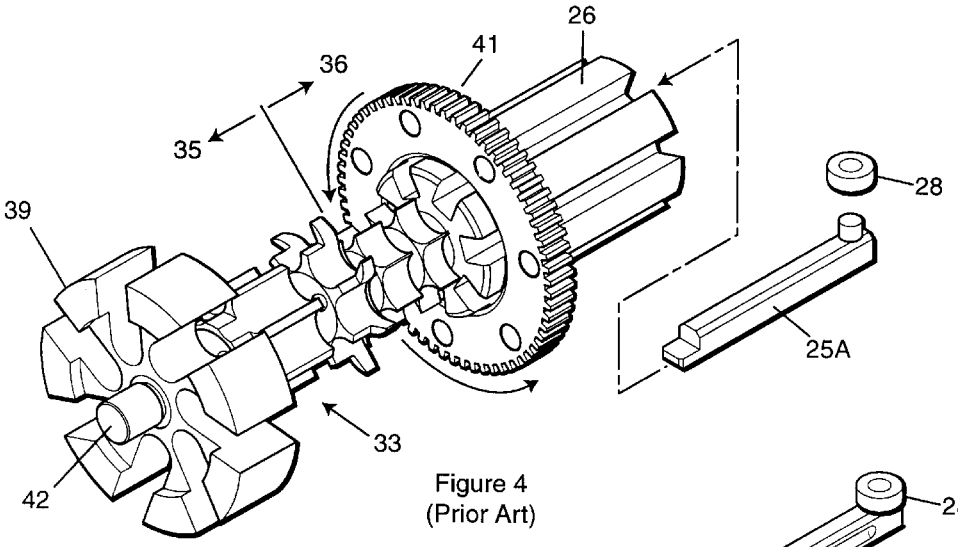
Figure 4 (Prior Art)
FIG. 4 is a perspective view of the interior rotatable assembly of the prior art feeder/delinker.
Figure 5:
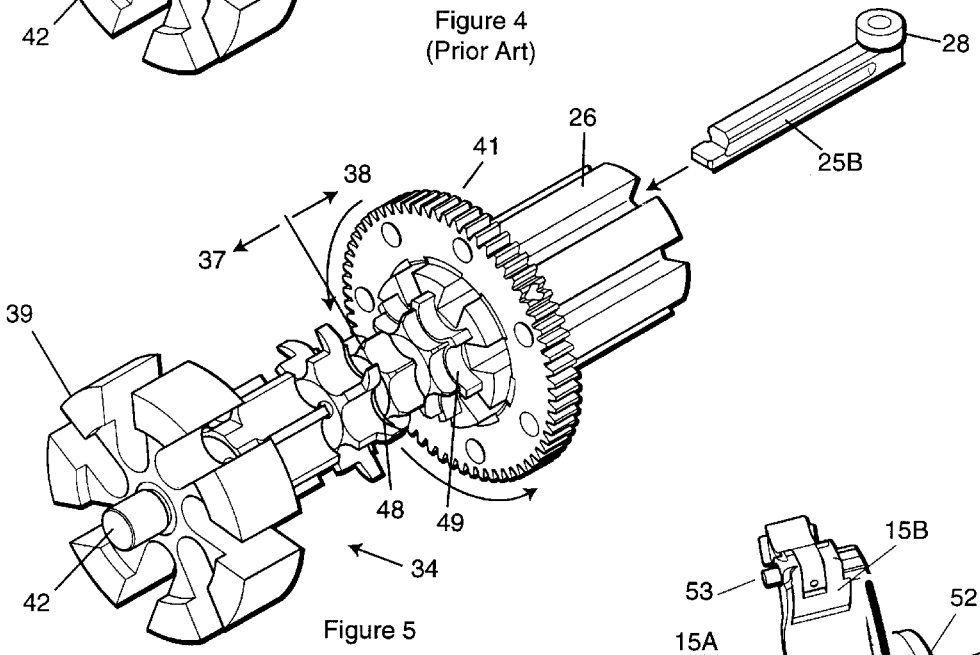
FIG. 5 is a perspective view of the interior rotatable assembly of the present invention.
Figure 7:
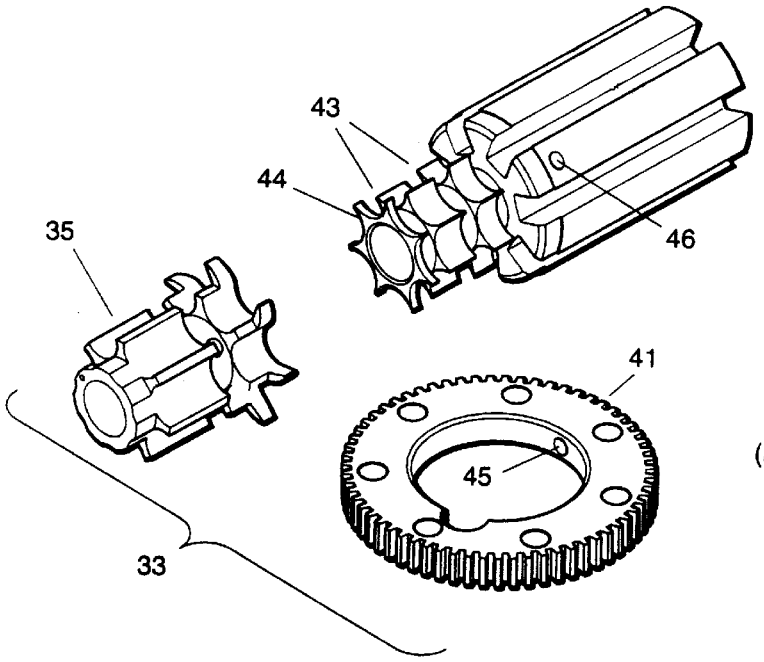
Figure 7 (Prior Art)
FIG. 7 is a perspective view of the rotatable assembly of the prior art feeder/delinker partially disassembled for the identification of fragile parts responsible for breakage during operation.
Figure 8:
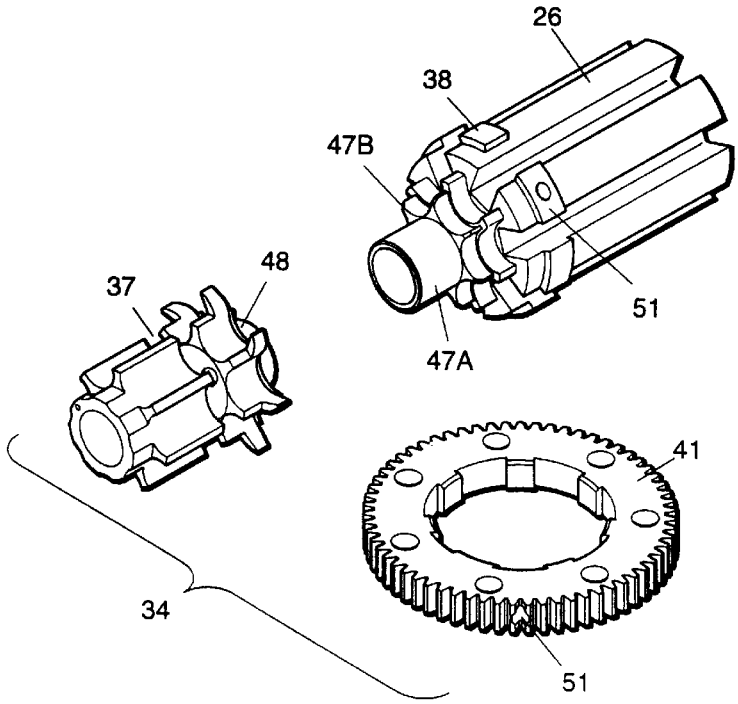
FIG. 8 is a corresponding perspective view of the rotatable assembly of the present invention illustrating measures taken to reduce breakage.
Figure 9:
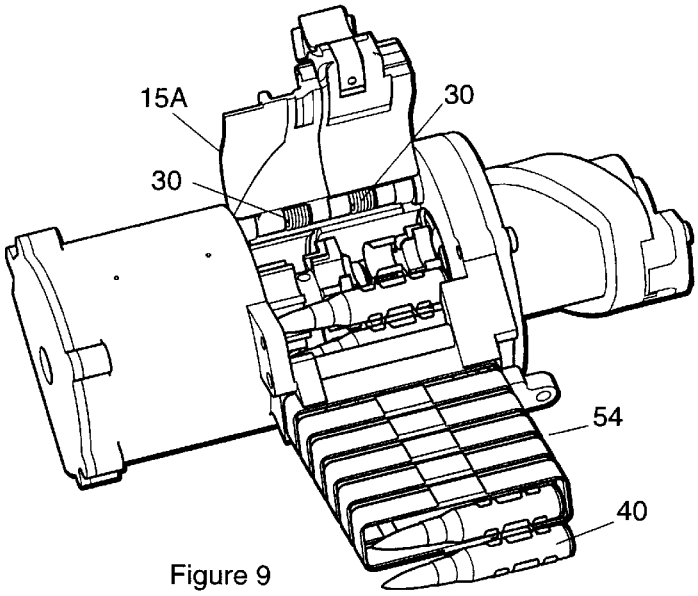
FIG. 9 is a perspective view of the feeder/delinker of the present invention with the hatch open and with an ammunition chute attached for delivery of a strip of cartridges to the feeder/delinker.

To illustrate the differences between the prior art and the present invention, compare the prior art rotatable assembly 33 shown in FIG. 4 and partially dissembled in FIG. 7 and the rotatable assembly 34 of the present invention shown in FIG. 5 and partially dissembled in FIG. 8. These differences are important contributors to trouble-free operation of the feeder/delinker. As shown in FIGS. 4 and 7, prior art rotatable assembly 33 comprises a forward delinker subassembly 35 and a rearward drive subassembly 36. As shown in FIGS. 5 and 8, present invention rotatable assembly 34 comprises a corresponding forward delinker subassembly 37 and a rearward drive subassembly 38.

In each subassembly 35–38, the design as well as the location of each of the individual wheels and sprockets is critical in terms of maintaining the high degree of alignment for the cartridges that is essential for assuring reliable, fault-free operation.

In addition to the smaller wheels and sprockets of the delinker and drive subassemblies 35–38, each of the assemblies 33 and 34 incorporate a feeder sprocket 39 employed in handing off cartridges 31 to gatling gun 18 and a drive gear 41 which couples rotatable assemblies 33 and 34 to drive motor 21. The drive and delinker subassemblies 35–38 are secured to a common shaft 42. The insertion of drive rod 25 with its drive wheel 28 into the drive rod guide 26 is shown with each of the FIGS. 4 and 5 to clarify the orientation of drive rod 25 relative to guide 26.

Prior art rotatable assembly 33 has a number of deficiencies that produce operating failures. The various wheels and sprockets have sharp corners 43 that end to break off producing debris that finds its way between operating parts and thereby causes misalignment and jamming. One wheel or sprocket 44 is especially fragile and susceptible to fracture, in part because of its relatively unprotected location.

There is also an alignment problem immediately ahead of the push rod guide 26, this problem being caused by inadequate support of the rearward end of cartridges 31 as they enter feeder/delinker 10.

Still another problem relates to the means by which drive gear 41 is secured to push rod guide 26. In prior art assembly 33, gear 41 is secured to push rod guide 26 by a single pin that passes through hole 45 in gear 41 and through hole 46 in guide 26. That pin is easily bent, throwing the entire assembly 33 out of time.

The present invention corrects these defects in a number of ways. Sharp corners 43 of the prior art are replaced by rounded edges 47. Fragile wheel or sprocket 44 of the prior art is moved from drive subassembly 36 to the delinker subassembly 37 wherein it abuts the rearward wheel or sprocket 48 thereof Robust wheel or sprocket 48 shields fragile wheel 44 protecting it from abnormal contacts with other parts or cartridges 31.

The alignment problem is corrected in the present invention by providing a second sprocket 49 immediately adjacent to the forward edge of push rod guide 26 where it pulls cartridges 31 evenly from both in front and at the rear of each link. In addition, the present invention attaches gear 41 and push rod guide 26 together using splines 51 thereby eliminating the problem of pin breakage.

To provide access to the interior of feeder/delinker 10 absent in the prior art, as shown in FIGS. 1, 2, 6 and 9, the present invention employs two doors 15A and 15B, mounted side-by-side on the side of feeder/delinker 10. In FIGS. 1 and 2, both doors 15 are closed; in FIG. 6, door 15A is being closed while door 15B is still open; in FIG. 9, both doors 15 are open.

The doors are driven by coil springs 30 to the open position and close against springs 30. Door 15B has a snap latch 52 that holds it closed against the action of spring 30. Door 15B further includes a holding pin 53 that engages a groove 55 in door 15A holding door 15A closed once door 15B is closed via snap latch 52.

Figure 6:
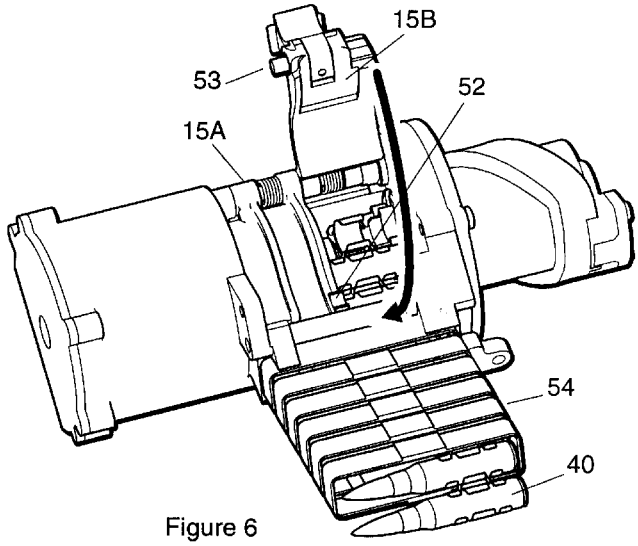
FIG. 6 is a perspective view of the feeder/delinker of the present invention showing a two door hatch in the process of being closed.

Access doors 15A and 15B facilitate the loading of a strip 40 of ammunition as shown in FIG. 6. The end of strip 40 is inserted through a flexible chute 54 and then positioned in cradle like slots of the interior rotatable assembly 34. Door 15A is then closed, the operator using his or her left hand to close door 15A while holding strip 40 in place with her or his right hand. In this position, door 15A holds strip 40 in place while door 15B is being closed with the right hand of the operator. In addition to the easy access for clearing jams, the use of access doors 15 has greatly simplified the process of the prior art which often required manual rotation of the ring 20 to properly feed strip 40 therethrough.

Figure 10:
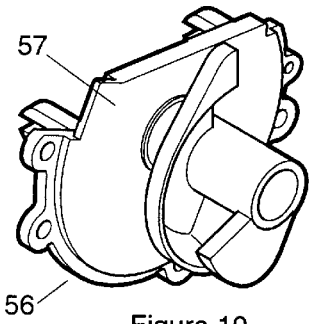
Figure 10 (Prior Art)
FIG. 10 is a perspective view showing the end plate of delivery guide of the prior art feeder/delinker.

As discussed previously, the prior art devices did not handle SLAP rounds because of inadequate control by an end plate 56, shown in FIG. 10, as cartridges 31 spiral outwardly for hand off to gatling gun 18. With end plate 56 engaging a tip 64 (see FIG. 3) of cartridges 31, tip 64 rode along the ramped spiral surface 57 of end plate 56. With tip control, the path of each tip 64 was not adequately or sufficiently defined, especially with the vibration of a operating gatling gun 18.

Figure 11:
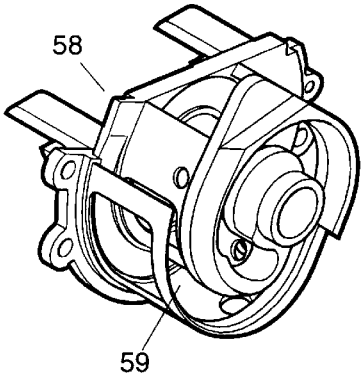
FIG. 11 is a perspective view of the improved end plate or delivery guide of the present invention.

In the improved end plate 58 of the present invention shown in FIG. 11, cartridge 31 is positioned off a shoulder 65 (see FIG. 3) with shoulder 65 being confined between two spiral walls 59. The double sided control enables feeder/delinker 10 to operate reliably even with SLAP rounds or blanks.

Figure 12:
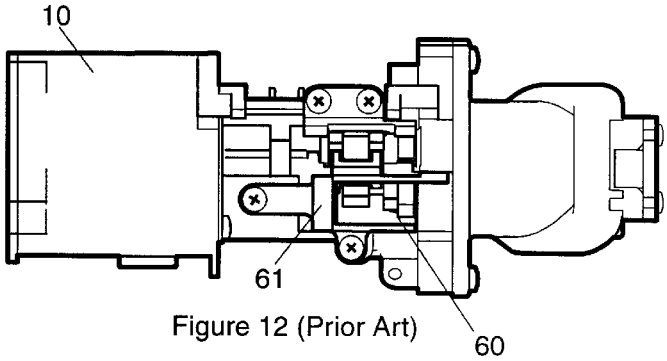
Figure 12 (Prior Art)
FIG. 12 is a perspective view showing the link exhaust port of the prior art feeder/delinker.
Figure 13:
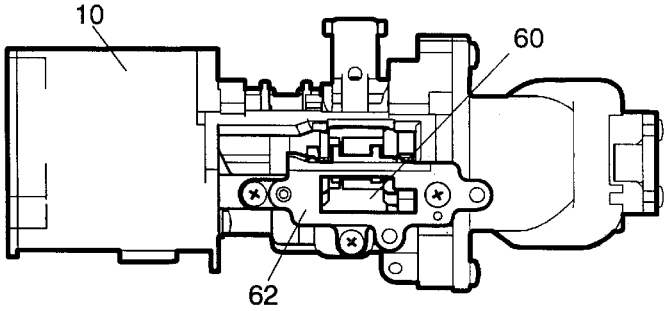
FIG. 13 shows the link exhaust port pad of the present invention.
Figure 14:
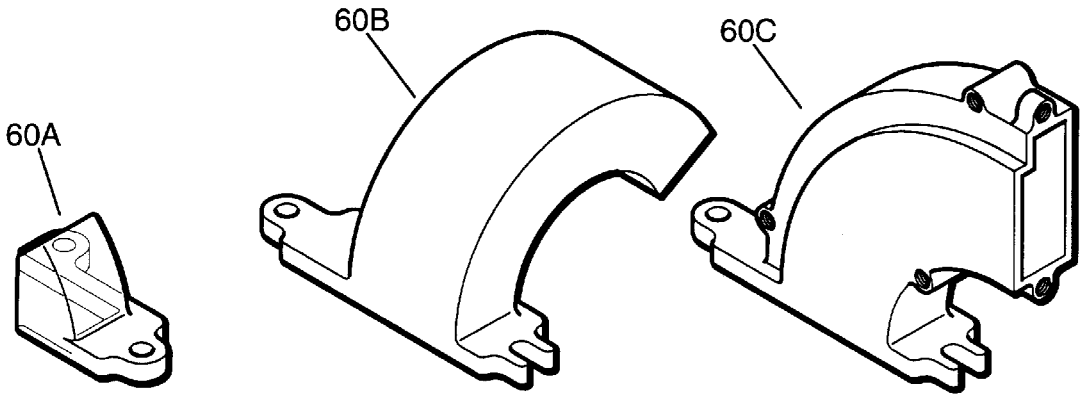
FIG. 14 shows collection chutes suitable for use with the link exhaust port pad of FIG. 13.

Still another improvement over the prior art is provided by link exhaust port 60 shown in FIGS. 12 and 13. In the prior art feeder/delinker 10' shown in FIG. 12, the links fell in an uncontrolled and unconfined manner from a rectangular opening 61 positioned just below the entry port for ammunition strip 40. In the improved feeder/delinker 10 shown in FIG. 13, a link exhaust port pad 62 is provided. Pad 62 allows the attachment of a collection chute 60A, 60B and 60C shown in FIG. 14 for exhaust links to divert same as desired.

It will be apparent that a significantly improved feeder/delinker 10 for a gatling gun 18 is provided in accordance with the stated objects of the present invention, and while but a single embodiment of the invention has been illustrated and described, it will be apparent to those skilled in the art that various changes and modifications may be made therein without departing from the spirit of the invention or from the scope of the appended claims.

That which is claimed is:

1. A feeder and delinker in combination with a gatling gun, the gatling gun comprising a plurality of gun barrels rotatably mounted in a ring, the feeder and delinker comprising:

a housing, a drive gear rotationally coupled to the plurality of gun barrels rotatably mounted in the ring, the drive gear extending through the housing;

a push rod guide and a plurality of push rods corresponding to and oriented parallel to the plurality of gun barrels rotatably mounted in the ring, the plurality of push rods being slidably received within a corresponding plurality of longitudinal grooves within the push rod guide, the push rod guide being rotationally coupled to the drive gear, a shaft extending through the push rod guide, the shaft being rotationally coupled to the push rod guide, the push rod guide, the plurality of push rods and the shaft being mounted within the housing;

means for sliding each of the plurality of push rods forwardly and backwardly, the sliding means being rotationally coupled to the drive gear;

a drive subassembly defining a plurality of channels corresponding to and aligned with the plurality of push rods, each of the plurality of channels adapted to receive a cartridge; the drive subassembly being mounted forwardly of the push rod guide;

a stripper subassembly defining a plurality of stripper channels corresponding to and aligned with the plurality of push rods, each of the plurality of stripper channels adapted to receive and prevent longitudinal movement of a cartridge link, the stripper subassembly being mounted forwardly of the drive subassembly on the shaft and rotationally coupled with the shaft;

an exhaust port for expelling links therefrom;

whereby a linked cartridge positioned in one of the drive subassembly channels and the corresponding stripper subassembly channel is urged longitudinally forwardly by the corresponding push rod, the push rod being moved longitudinally by the sliding means, the stripper subassembly retaining the cartridge link thereby stripping the cartridge from the link, the link being expelled from the exhaust port;

a feeder sprocket adapted to receive cartridges from the stripper subassembly after the cartridges have been stripped of cartridge links;

an end plate adapted to guide cartridges in the feeder sprocket from the stripper subassembly to the gatling gun;

a pair of the hatch doors mounted on the housing, the pair of hatch doors being positioned proximate to the drive subassembly and the stripper subassembly, the pair of doors adapted to allow access to the interior of the housing, the pair of hatch doors being separably closable, whereby the pair of hatch doors permits loading of linked cartridges and clearing of jams when open, and, when one of the pair of hatch doors is closed, the closed one of the pair of hatch doors temporarily securing the linked cartridges in the drive and stripper subassemblies until the second door is closed.

2. The feeder and delinker of claim 1 further wherein the end plate has two parallel guide walls adapted to engage the shoulder of a cartridge to guide the cartridge from the stripper subassembly to the gatling gun.

3. The feeder and delinker of claim 1 wherein the drive subassembly and the stripper subassembly are provided with rounded edges.

4. The feeder and delinker of claim 1 further comprising a sprocket mounted between the drive subassembly and the push rod guide, the sprocket adapted to provide further alignment of the cartridges.

5. The feeder and delinker of claim 1 further comprising an exhaust port pad having means for attaching a plurality of exhaust chutes thereto.

6. A feeder and delinker in combination with a gatling gun, the gatling gun comprising a plurality of gun barrels rotatably mounted in a ring, the feeder and delinker comprising:

a housing, a drive gear rotationally coupled to the plurality of gun barrels rotatably mounted in the ring, the drive gear extending through the housing;

a push rod guide and a plurality of push rods corresponding to and oriented parallel to the plurality of gun barrels rotatably mounted in the ring, the plurality of push rods being slidably received within a corresponding plurality of longitudinal grooves within the push rod guide, the push rod guide being rotationally coupled to the drive gear by a plurality of splines, a shaft extending through the push rod guide, the shaft being rotationally coupled to the push rod guide, the push rod guide, the plurality of push rods and the shaft being mounted within the housing;

means for sliding each of the plurality of push rods forwardly and backwardly, the sliding means being rotationally coupled to the drive gear;

drive subassembly defining a plurality of channels corresponding to and aligned with the plurality of push rods, each of the plurality of channels adapted to receive a cartridge; the drive subassembly being mounted forwardly of the push rod guide;

a stripper subassembly defining a plurality of stripper channels corresponding to and aligned with the plurality of push rods, each of the plurality of stripper channels adapted to receive and prevent longitudinal movement of a cartridge link, the stripper subassembly being mounted forwardly of the drive subassembly on the shaft and rotationally coupled with the shaft;

an exhaust port for expelling cartridge links;

whereby a linked cartridge positioned in one of the drive subassembly channels and the corresponding stripper subassembly channel is urged longitudinally forwardly by the corresponding push rod, the push rod being moved longitudinally by the sliding means, the stripper subassembly retaining the cartridge link thereby stripping the cartridge from the link, the links being expelled via the exhaust port;

a feeder sprocket adapted to receive cartridges from the stripper subassembly after the cartridges have been stripped of cartridge links; and an end plate adapted to guide cartridges in the feeder sprocket from the stripper subassembly to the gatling gun, the end plate having two parallel guide walls adapted to engage the shoulder of a cartridge to guide the cartridge from the stripper subassembly to the gatling gun.

7. The feeder and delinker of claim 6 wherein the drive subassembly and the stripper subassembly are provided with rounded edges.

8. The feeder and delinker of claim 6 further comprising a sprocket mounted between the drive subassembly and the push rod guide, the sprocket adapted to provide further alignment of the cartridges.

9. The feeder and delinker of claim 6 further comprising an exhaust port pad having means for attaching a plurality of exhaust chutes thereto.

10. A feeder and delinker in combination with a gatling gun, the gatling gun comprising a plurality of gun barrels rotatably mounted in a ring, the feeder and delinker comprising:

a housing, a drive gear rotationally coupled to the plurality of gun barrels rotatably mounted in the ring, the drive gear extending through the housing;

a push rod guide and a plurality of push rods corresponding to and oriented parallel to the plurality of gun barrels rotatably mounted in the ring, the plurality of push rods being slidably received within a corresponding plurality of longitudinal grooves within the push rod guide, the push rod guide being rotationally coupled to the drive gear by seven splines, a shaft extending through the push rod guide, the shaft being rotationally coupled to the push rod guide, the push rod guide, the plurality of push rods and the shaft being mounted within the housing;

means for sliding each of the plurality of push rods forwardly and backwardly, the sliding means being rotationally coupled to the drive gear;

a drive subassembly defining a plurality of channels corresponding to and aligned with the plurality of push rods, each of the plurality of channels adapted to receive a cartridge; the drive subassembly being mounted forwardly of the push rod guide;

a stripper subassembly defining a plurality of stripper channels corresponding to and aligned with the plurality of push rods, each of the plurality of stripper channels adapted to receive and prevent longitudinal movement of a cartridge link, the stripper subassembly being mounted forwardly of the drive subassembly on the shaft and rotationally coupled with the shaft;

an exhaust port for expelling cartridge links, the exhaust port having an exhaust port pad adapted to mount a plurality of exhaust chutes thereon;

whereby a linked cartridge positioned in one of the drive subassembly channels and the corresponding stripper subassembly channel is urged longitudinally forwardly by the corresponding push rod, the push rod being moved longitudinally by the sliding means, the stripper subassembly retaining the cartridge link thereby stripping the cartridge from the link, the links being expelled via the exhaust port;

a feeder sprocket adapted to receive cartridges from the stripper subassembly after the cartridges have been stripped of cartridge links;

an end plate adapted to guide cartridges in the feeder sprocket from the stripper subassembly to the gatling gun, the end plate having two parallel guide walls adapted to engage the shoulder of a cartridge to guide the cartridge from the stripper subassembly to the gatling gun; and a pair of the hatch doors mounted on the housing, the pair of hatch doors being positioned proximate to the drive subassembly and the stripper subassembly, the pair of doors adapted to allow access to the interior of the housing, the pair of hatch doors being separably closable, whereby the pair of hatch doors permits loading of linked cartridges and clearing of jams when open, and, when one of the pair of hatch doors is closed, the closed one of the pair of hatch doors securing the linked cartridges in the drive and stripper subassemblies.

11. The feeder and delinker of claim 10 wherein the drive subassembly and the stripper subassembly are provided with rounded edges.

12. The feeder and delinker of claim 10 further comprising a sprocket mounted between the drive subassembly and the push rod guide, the sprocket adapted to provide further alignment of the cartridges.

* * * * *